US010358242B2

(12) United States Patent
Ours et al.

(10) Patent No.: US 10,358,242 B2
(45) Date of Patent: Jul. 23, 2019

(54) DRIVE SYSTEM AND METHOD FOR FORMING A TRANSPORTABLE CONTAINER FOR BULK GOODS

(71) Applicant: Kellogg Company, Battle Creek, MI (US)

(72) Inventors: David C. Ours, Marshall, MI (US); Paul D. Drouin, Allegan, MI (US); Gary W. Gunia, Portage, MI (US); Stephen Michael Aloff, Midland, MI (US)

(73) Assignee: Kellogg Company, Battle Creek, MI (US)

( * ) Notice: Subject to any disclaimer, the term of this patent is extended or adjusted under 35 U.S.C. 154(b) by 498 days.

(21) Appl. No.: 15/179,044

(22) Filed: Jun. 10, 2016

(65) Prior Publication Data

US 2016/0280408 A1 Sep. 29, 2016

Related U.S. Application Data

(62) Division of application No. 13/648,652, filed on Oct. 10, 2012, now Pat. No. 9,387,944.

(Continued)

(51) Int. Cl.

| | |
|---|---|
| ***B65B 1/02*** | (2006.01) |
| ***B65B 43/60*** | (2006.01) |
| ***B65B 11/04*** | (2006.01) |
| ***B65B 57/12*** | (2006.01) |
| ***B65B 65/02*** | (2006.01) |

(Continued)

(52) U.S. Cl.

CPC ..... *B65B 43/60* (2013.01); *B65B 11/045* (2013.01); *B65B 57/12* (2013.01); *B65B 65/02* (2013.01); *B65B 11/04* (2013.01); *B65B 43/58* (2013.01); *B65B 43/62* (2013.01); *B65B 2011/002* (2013.01)

(58) Field of Classification Search

CPC ..... B65B 43/60; B65B 1/06; B65B 43/08; B65B 2210/00; B65B 2210/14; B65B 2210/16; B65B 11/025; B65B 11/045; B65B 11/58; B65B 2011/002

USPC ..... 4/556–557, 52, 64, 176, 399, 441, 49, 4/452, 558, 580, 582, 588, 456; 141/10

See application file for complete search history.

(56) References Cited

U.S. PATENT DOCUMENTS 6,494,324 B2 * 12/2002 Ours ..... B65B 1/02 206/527

8,191,341 B2 * 6/2012 Ours ..... B65B 1/02 53/399

* cited by examiner

*Primary Examiner* — Lori L Baker

(74) *Attorney, Agent, or Firm* — Honigman LLP; Kathryn D. Doyle, Esq.; Jonathan P. O'Brien

(57) ABSTRACT

A packaging system (20) for forming and filling a transportable container (22) of plurality of bulk goods includes a frame (26) having a bottom support (48) and an upper support (32). An upper turntable (34) is rotatably supported within the upper support (32) and a lower turntable (50) is rotatably supported on the bottom support (48). A drive system (58) includes at least one pulley system (62, 64, 66) interconnected to the upper and lower turntables (34, 50) for simultaneously driving and synchronizing rotation of the upper and lower turntables (34, 50) with the at least one pulley system (62, 64, 66). A slip frame former (42) extends downwardly from the upper turntable (34) and a roll of stretch wrap (92) is disposed in overlapping relationship with the slip frame former (42) and the bottom support (48) during simultaneous and synchronized rotation of the turntables (34, 50) with the at least one pulley system (62, 64, 66).

16 Claims, 8 Drawing Sheets

Related U.S. Application Data

(60) Provisional application No. 61/545,336, filed on Oct. 10, 2011.

(51) Int. Cl.

| | |
|---|---|
| *B65B 43/58* | (2006.01) |
| *B65B 43/62* | (2006.01) |
| *B65B 11/00* | (2006.01) |

DRIVE SYSTEM AND METHOD FOR FORMING A TRANSPORTABLE CONTAINER FOR BULK GOODS

CROSS REFERENCE TO RELATED APPLICATION

This application is a divisional of U.S. patent application Ser. No. 13/648,652, filed Oct. 10, 2012, entitled Drive System and Method for Forming A Transportable Container of Bulk Goods, which claims the benefit of U.S. Provisional Patent Application Ser. No. 61/545,336, filed on Oct. 10, 2011, and entitled a "Drive System For Forming Transportable Container for Bulk Goods", which are hereby incorporated by reference in their entirety.

BACKGROUND OF THE INVENTION

1. Field of the Invention

A packaging system and method for forming and filling a transportable container with a plurality of bulk goods received from a feed source.

2. Description of the Prior Art

The prior art packaging systems to which the subject invention pertains are packaging systems which include turntables driven by mechanical drives. One such packaging system is disclosed in U.S. Pat. No. 8,104,520 to Ours, et al wherein a frame of the packaging system includes a bottom support and an upper support and at least one support column extending therebetween. An upper turntable is rotatably supported within the upper support and defines a feed opening for receiving the bulk goods from the feed source, and a lower turntable is rotatably supported on the bottom support. A drive system including a drive is interconnected to the upper and lower turntables for generating a mechanical force to drive rotation of the upper and lower turntables.

Although the prior art packaging systems are capable of driving rotation of the upper and lower turntables, these packaging systems require multiple heavy chain drives and motors to establish rotation of both the upper and lower turntables. In addition, the prior art drives can often require the use of discrete, interlocking mechanical members such as chain sprockets, spur gears or timing belts. Accordingly, there remains a need for a packaging system which can drive rotation of the upper and lower turntables using less complex and less expensive drive systems.

SUMMARY OF THE INVENTION AND ADVANTAGES

The invention provides for a drive system including at least one pulley system interconnected to at least one of the upper and lower turntables and the drive for receiving a rotational force from the drive and communicating the rotational force to the at least one pulley system to simultaneously drive and synchronize a rotational speed of the upper and lower turntables. The pulley system of the subject invention achieves a straight and uniform square load of bulk goods in the transportable container through the use of a simple belt and pulley system. Said another way, the pulley system of the subject invention maintains straightness and squareness for an entire fill cycle of the bulk goods in the transportable without separate mechanical drives for each of the upper and lower turntables. Accordingly, the pulley system eliminates the need for separate and distinct mechanical drives as currently required in the prior art packaging systems, and thus reduces cost and complexity of the packaging system.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Referring to the Figures, wherein like numerals indicate corresponding parts throughout the several views, a packaging system 20 for forming and filling a transportable container 22 with a plurality of bulk goods received from a feed source 24 is generally shown in FIGS. 1-6 and 8.

Throughout the present specification and claims the phrase "bulk goods" is used as a shorthand version of the wide range of products that can be packaged utilizing the present invention. The present invention finds utilization in packaging any material that can be bulk packaged. These items can encompass large bulk packaged pieces as well as very small bulk packaged pieces. Examples of smaller bulk goods include, but are not limited to, the following: agricultural products like seeds, rice, grains, vegetables, fruits, chemical products like fine chemicals, pharmaceuticals, raw chemicals, fertilizers, plastics like plastic resin pellets, plastic parts, rejected plastic pails, machined plastic parts, cereals and cereal products such as wheat, a variety of machined parts of all sorts, wood products like wood chips, landscaping material, peat moss, dirt, sand, gravel, rocks and cement. The present invention also finds utilization in bulk packaging of larger bulk goods including, but not limited to: prepared foods, partially processed foods like frozen fish, frozen chicken, other frozen meats and meat products, manufactured items like textiles, clothing, footwear, toys like plastic toys, plastic half parts, metallic parts, soft toys, stuffed animals, and other toys and toy products. All of these types of materials and similar bulk packaged materials are intended to be encompassed in the present specification and claims by this phrase.

Figure 1:
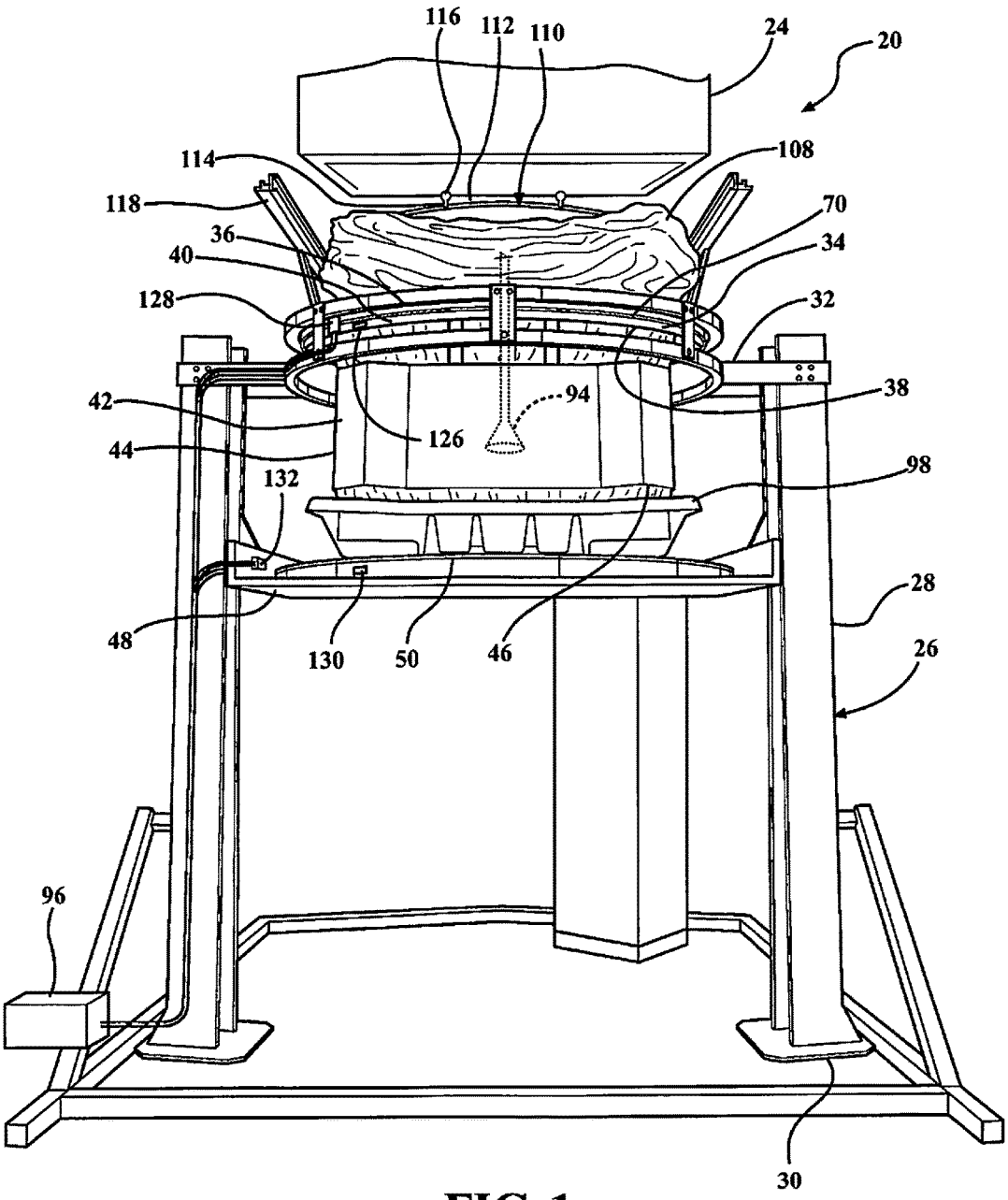
FIG. 1 is a front view of a packaging system illustrating a bottom support and an upper support disposed in a first position.
Figure 2:
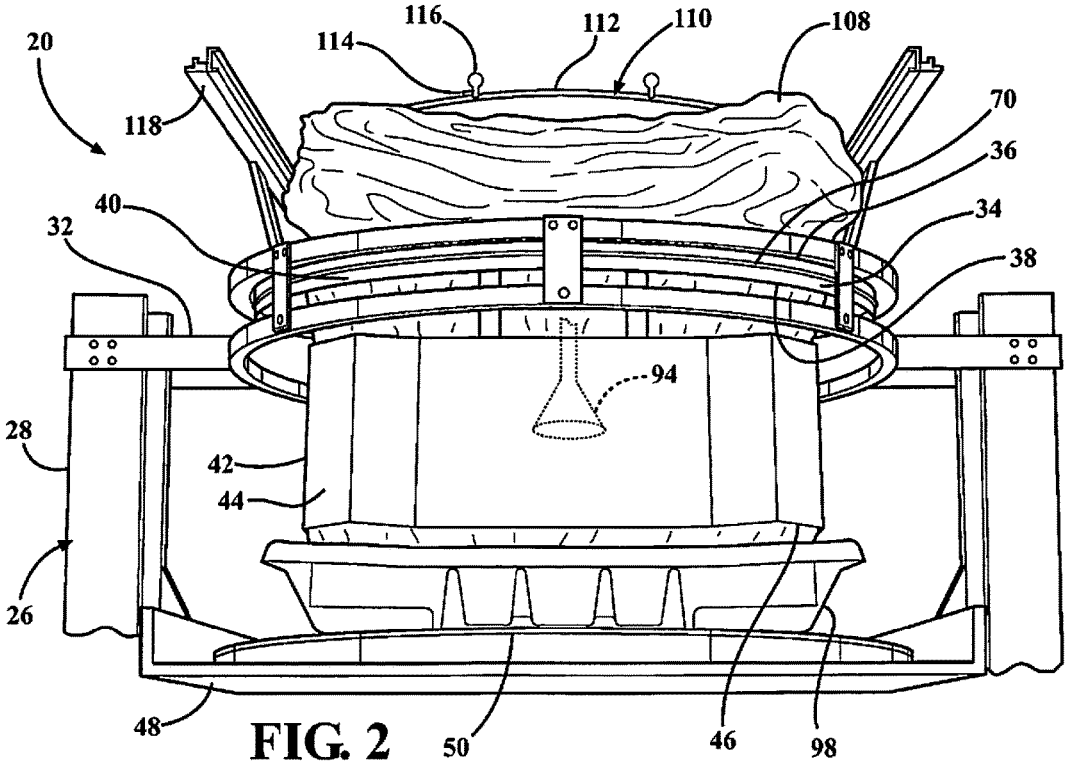
FIG. 2 is a magnified view of a portion of FIG. 1 illustrating an intermediate carrier for supporting a bag which extends through a feed opening of the upper support and a frame opening of a slip frame former to a transportable base.
Figure 3:
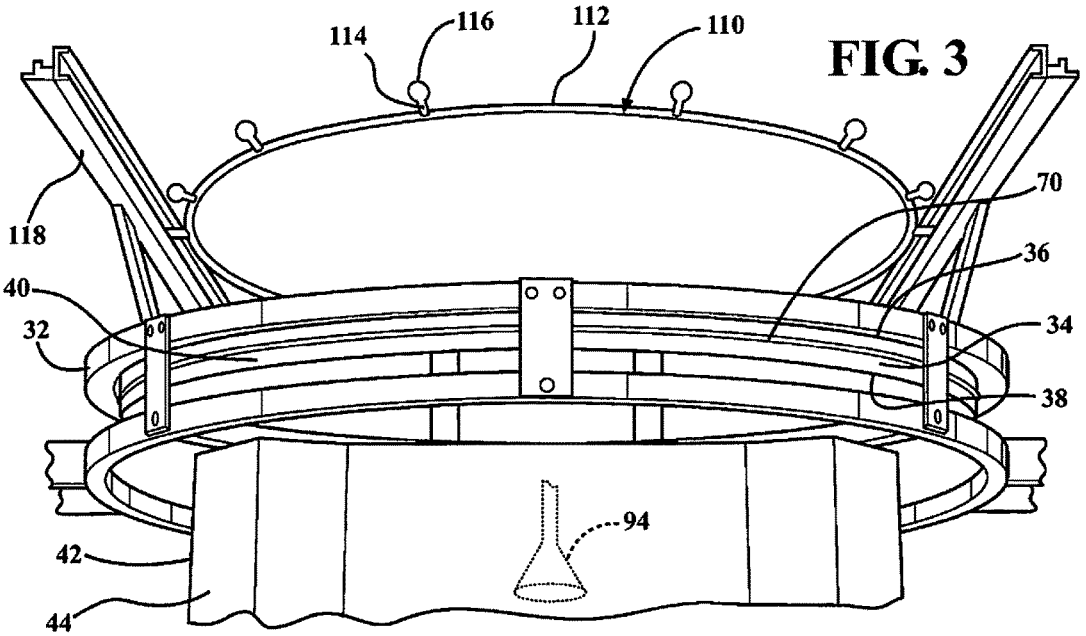
FIG. 3 is a magnified view of a portion of FIG. 2 illustrating the intermediate carrier after the bag has been removed therefrom.

As best shown in FIG. 1, the packaging system 20 includes a frame 26 having at least one support column 28 extending between a frame base 30 and an upper support 32. In the preferred embodiment, a pair of support columns 28 extend between the frame base 30 and the upper support 32, but any number of support columns 28 may be used. An upper turntable 34 is rotatably supported within the upper support 32 and has a circumferential edge 36 which defines a feed opening 38 for receiving the bulk goods from the feed source 24. In the preferred embodiment, the upper turntable 34 is circular, however other suitable shapes such as square, triangular, or the like could also be used. As best shown in FIGS. 1-3, the upper turntable 34 includes an upper guide track 40 extending downwardly from the circumferential edge 36 of the upper turntable 34, and a slip frame former 42 is secured to and extends downwardly from the upper guide track 40 of the upper turntable 34. The slip frame former 42 is centered within the packaging system 20 and may be round, square or any other desired shape.

The slip frame former 42 has at least one former wall 44 to define a frame opening 46 disposed in fluid communication with the feed opening 38. In the preferred embodiment, the former walls 44 are from about six to fifteen inches in height and may be made from metal, plastic, or any other material known in the art. Further, the at least one former wall 44 is a continuous wall that extends down from the entirety of the upper turntable 34. However, the at least one former wall 44 could also include former arms or fingers (not expressly shown) extending downwardly from the upper turntable 34.

Figure 8:
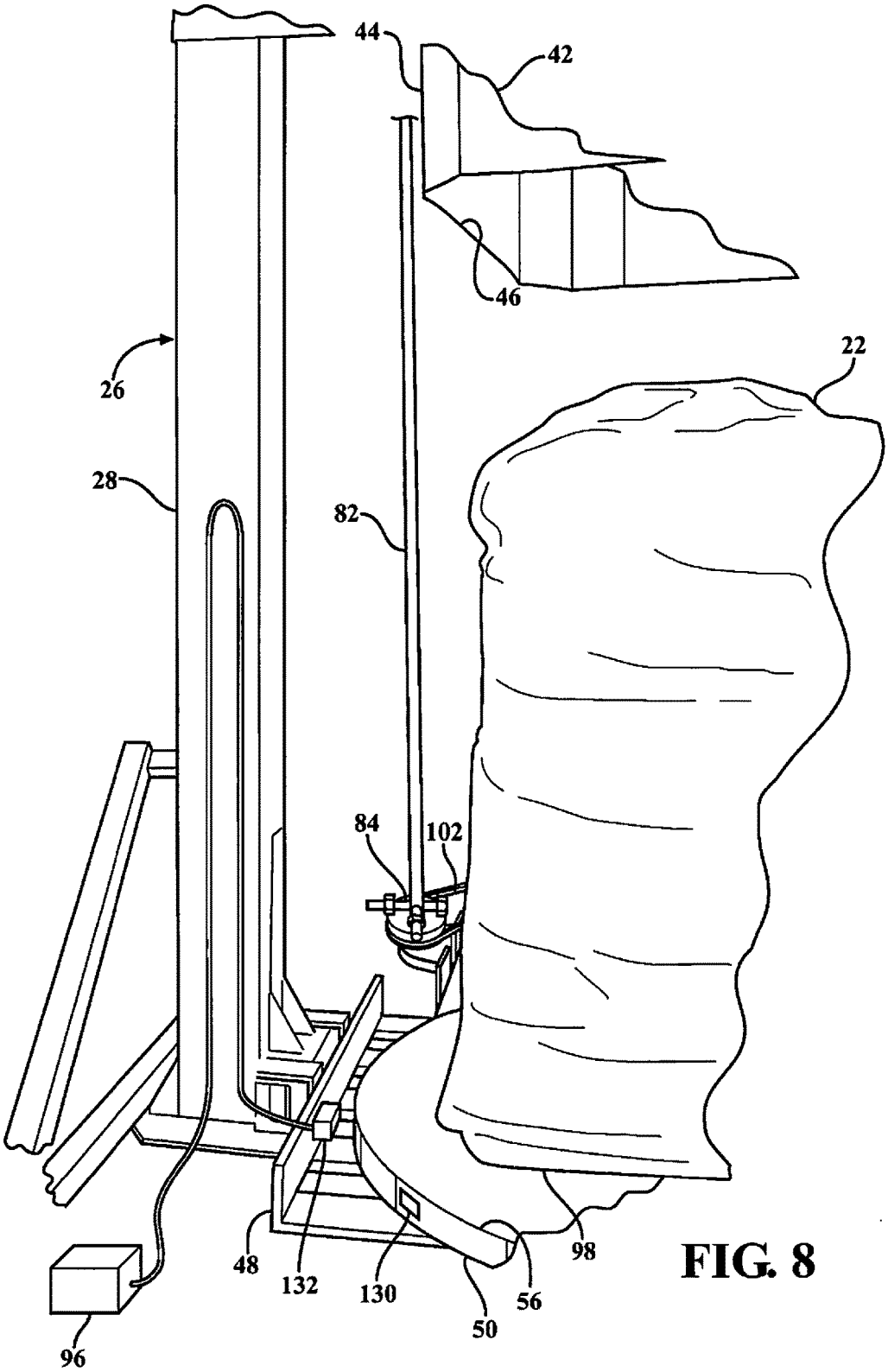
FIG. 8 is a partial front view of the packaging system illustrating the bottom support and the upper support disposed in a second position and the transportable container formed according to the subject invention.

The packaging system 20 further includes a bottom support 48 attached to the at least one support column 28 of the frame 26 and a lower turntable 50 is rotatably supported on the bottom support 48. As best shown in FIG. 8, the lower turntable 50 includes a turntable shaft 52 rotatably connected to the bottom support 48 and a lower guide track 54 is fixedly attached to the turntable shaft 52 for rotation therewith. In the preferred embodiment, the lower guide track 54 is circular in shape. In addition, as best shown in FIG. 8, a lower turntable platform 56 is secured to and overlays the lower guide track 54 for rotation with the turntable shaft 52 and the lower guide track 54. In the preferred embodiment, the lower turntable 50 is also circular, however other suitable shapes such as square, triangular, or the like could also be used.

Figure 4:
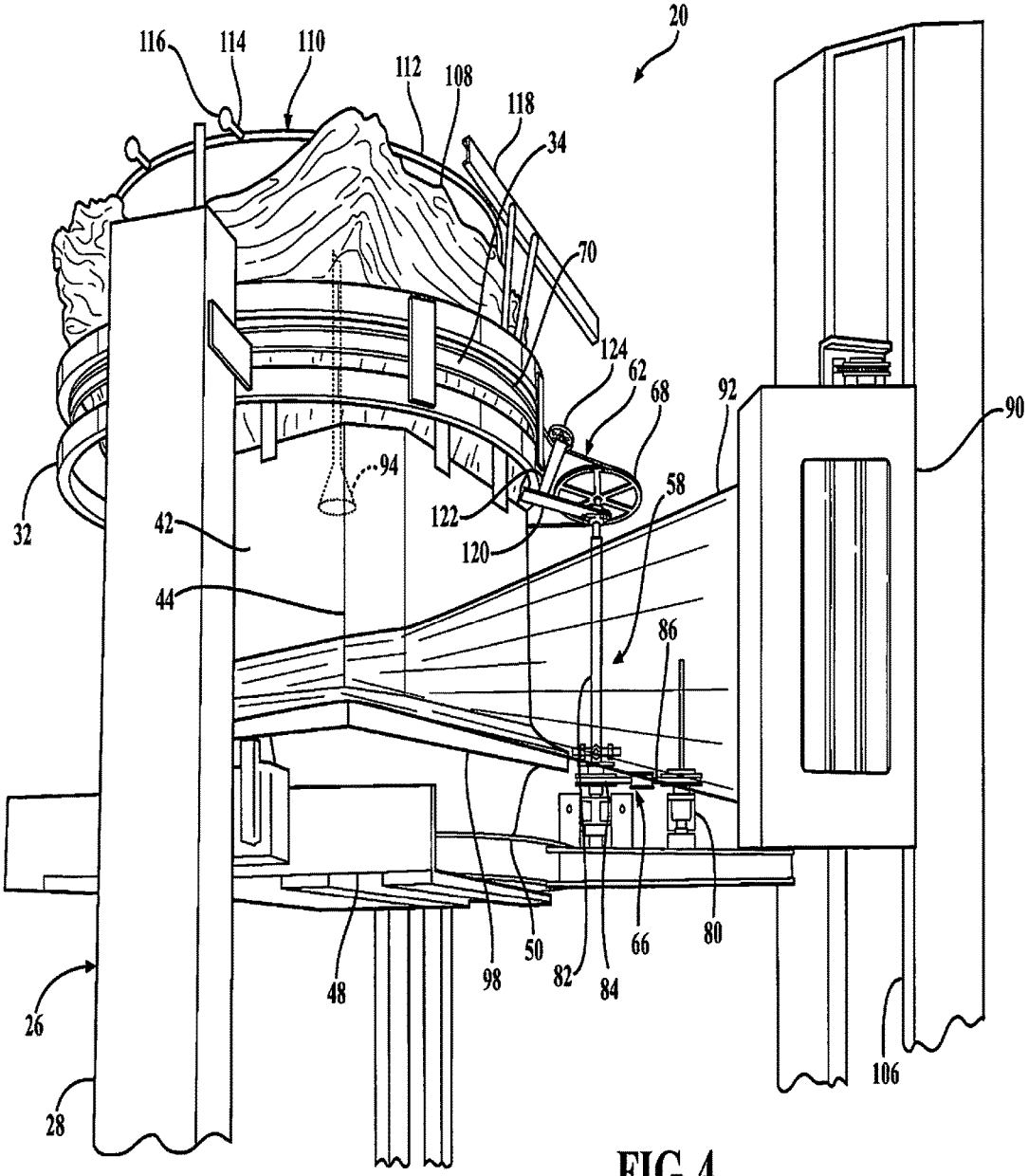
FIG. 4 is a perspective view of the packaging system illustrating a stretch wrapping device including a roll of stretch wrap disposed in overlapping relationship with at least a portion of a former wall of the slip frame former and a transportable base disposed on the bottom support in the first position.
Figure 9:
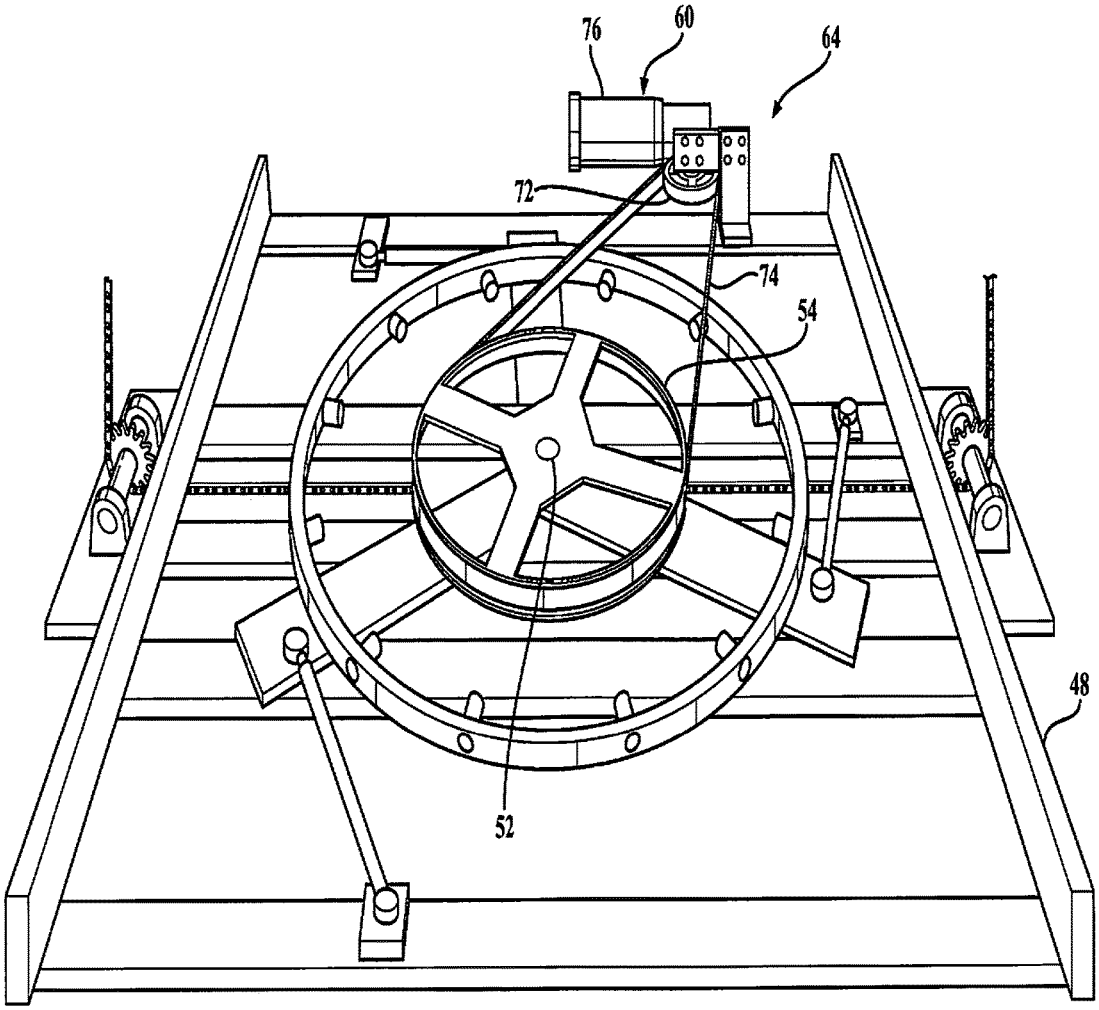
FIG. 9 is a perspective view of a lower pulley system.

As best shown in FIG. 4, the packaging system 20 further includes a drive system 58 including a drive 60 that is interconnected to the upper and lower turntables 34, 50 for generating a rotational force to drive rotation of the upper and lower turntables 34, 50. As best shown in FIGS. 4 and 9, the drive system 58 includes a plurality of pulley systems 62, 64, 66 in communication with the upper and lower turntables 34, 50 and the drive 60 for receiving the rotational force and communicating the rotational force to the plurality of pulley systems 62, 64, 66 to simultaneously drive the upper and lower turntables 34, 50 and synchronize a rotational speed of the upper and lower turntables 34, 50. The plurality of pulley systems 62, 64, 66 includes an upper pulley system 62 in communication with the upper turntable 34 for driving rotation of the upper turntable 34 and a lower pulley system 64 in communication with the lower turntable 50 for driving rotation of the lower turntable 50. In the preferred embodiment, the upper pulley system 62 includes an upper pulley 68 and an upper belt 70 extending around both of the upper pulley 68 and the upper guide track 40 of the upper turntable 34 and the lower pulley system 64 includes a lower pulley 72 and a lower belt 74 extending around both of the lower pulley 72 and the lower guide track 54 of the lower turntable 50.

Figure 7:
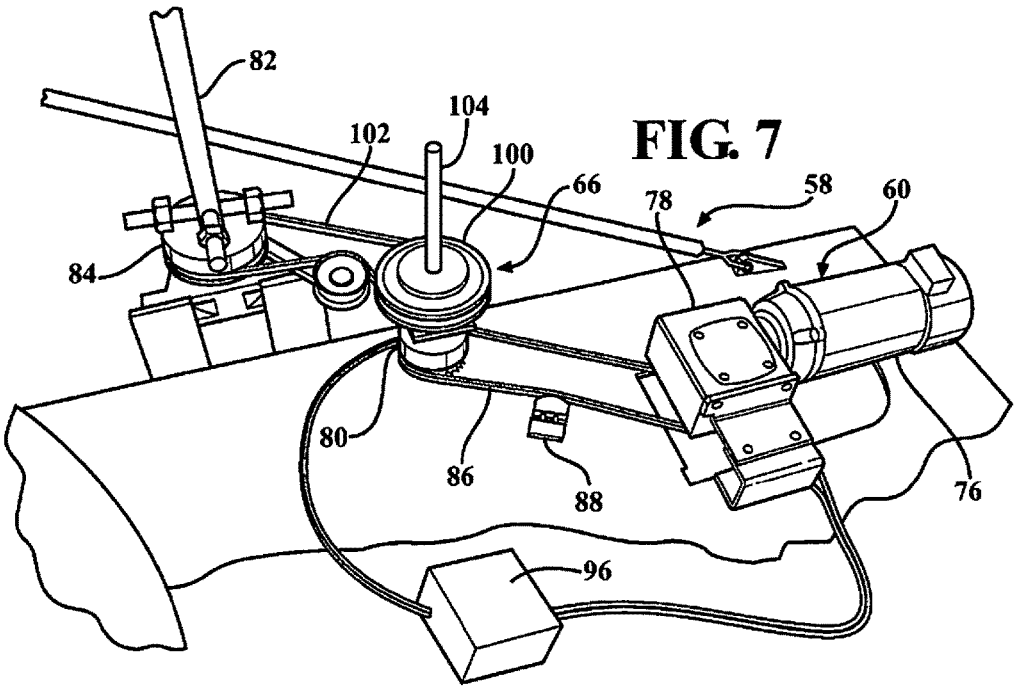
FIG. 7 is a perspective view of the drive system illustrating a clutch and a variable pulley system disposed between a drive and a drive coupling.

The drive 60 of the drive system 58 includes a drive motor 76 and a gearbox 78 disposed on the bottom support 48 and interconnected to both of the upper and lower pulley systems 62, 64 for generating the rotational force and simultaneously communicating the rotational force to both of the upper and lower pulley systems 62, 64. As best shown in FIG. 7, the drive system 58 also includes a clutch 80 disposed between the drive 60 and the upper pulley system 62 that is adjustable between an engaged position to allow transfer of the rotational force from the drive 60 to the upper pulley system 62 and a disengaged position to cease transfer of the rotational force from the drive 60 to the upper pulley system 62. As also shown in FIG. 7, the drive system 58 includes a coupling shaft 82 extending downwardly from the upper pulley 68 to a drive coupling 84 interconnected to the clutch 80 and the drive motor 76 for transferring the rotational force from the drive motor 76 to the upper pulley system 62. In addition, the drive system 58 includes a drive belt 86 which interconnects the drive 60 and the clutch 80 and a drive belt tensioner 88 which adjusts a tension of the drive belt 86 extending therebetween.

At least one of the bottom support 48 and the upper support 32 are vertically movable relative to the other along the at least one support column 28 between a first position, as shown in FIG. 4, wherein the bottom support 48 is disposed adjacent the upper support 32 and the slip frame former 42 to a second position, as shown in FIG. 8, wherein the bottom support 48 is disposed in spaced relationship with the upper support 32 and the slip frame former 42. In the preferred embodiment, the bottom support 48 moves vertically downward relative to the upper support 32 along the pair of support columns 28 from the first position to the second position. The relative vertical movement of the bottom support 48 and the upper support 32 can be accomplished by any of a variety of lift mechanisms (not expressly shown) including, but not limited to, scissors platform legs, hydraulic pistons, pneumatic pistons, or a geared mechanism. Prior to receiving bulk goods, in the preferred embodiment, the lift mechanism lifts the bottom support 48 to the initial first position adjacent the slip frame former 42.

The packaging system 20 also includes a stretch wrapping device 90 disposed in spaced and aligned relationship with at least a portion of the former wall 44 of the slip frame former 42. As best shown in FIG. 4, the stretch wrapping device 90 includes a roll of stretch wrap 92 extending outwardly from the stretch wrapping device 90 and disposed in overlapping relationship with at least a portion of the former wall 44 and the bottom support 48 in the first position to encircle both of the bottom support 48 and the at least one former wall 44 of the slip frame former 42 during an initial simultaneous rotation of the upper and lower turntables 34, 50 to initially form the transportable container 22 extending therebetween. The shape of the transportable container 22 is determined by the shape of the slip frame former 42. For example, a round slip frame former 42 will produce a round transportable container 22 while a generally square slip frame former 42 will produce a square transportable container 22. As best shown in FIG. 1, the feed source 24 is disposed in communication with the feed opening 38 of the upper support 32 and the frame opening 46 of the slip frame former 42 for transferring the bulk goods from the feed source 24 to the transportable container 22 during simultaneous rotation of the upper and lower turntables 34, 50.

The packaging system 20 also includes at least one sensor 94 which extends downwardly from the upper support 32 for sensing a fill level of the bulk goods within the transportable container 22, and a controller 96 is in communication with the at least one sensor 94 for receiving the fill level and comparing the fill level to a predetermined threshold to generate a fill signal when the fill level exceeds the predetermined threshold during the filling of the transportable container 22 with bulk goods. The controller 96 is also in in communication with at least one of the bottom support 48 and the upper support 32 to initiate the relative vertical movement of the bottom support 48 and the upper support 32 in response to the fill signal for disengaging previously disposed portions of stretch wrap 92 from the slip frame former 42 to squeeze the filled portions of the transportable container 22 with the stretch wrap 92 and lock together the bulk goods disposed therein.

In the preferred embodiment, the transportable container 22 includes a transportable base 98 that is placed on the lower turntable 50 and is also used to begin the initial forming of the transportable container 22. Said another way, the roll of stretch wrap 92 extends outwardly from the stretch wrapping device 90 and is disposed in overlapping relationship with at least a portion of the former wall 44 and the transportable base 98 disposed on the bottom support 48 in the first position to encircle both the transportable base 98 and the at least on former wall 44 during an initial simultaneous rotation of the upper and lower turntables 34, 50. Accordingly, the rotation of the lower turntable 50 also drives rotation of the transportable base 98 when the transportable base 98 is used to form the transportable container 22. The transportable base 98 is made of molded plastic, but may be manufactured by any process known in the art and made of any other material known in the art. In a preferred embodiment, the transportable base 98 is square, but the transportable base 98 may be round or any other shape known in the art. The square transportable container 22 allows for the greatest amount of space to be utilized when a plurality of transportable containers 22 are placed next to one another in a shipping truck. The transportable base 98 initially forms the bulk goods or particulates disposed in the transportable container 22 and further allows for the transportation of the transportable container 22. The transportable base 98 may further be a slip sheet, pallet or any other transportable base 98 known in the art. The slip sheet is typically a folded sheet of cardboard, but may be any other material known in the art, including but not limited to plastic. The pallet may be wood, plastic or any other material known in the art. Typically, the pallet and the slip sheet are used together.

The controller 96 is also disposed in communication with the clutch 80 of the drive system 58 to disengage the clutch 80 during the relative vertical movement of the bottom support 48 and the upper support 32 for ceasing transfer of the rotational force from the drive motor 76 to the upper turntable 34. Accordingly, rotation of the upper turntable 34 is accomplished using only the overlapped layers of stretch wrap 92 extending between the bottom support 48 and the slip frame former 42 and thus straightness of the bulk goods transferred to the transportable container 22 is maintained during the fill cycle without the need to drive the upper turntable 34 with the upper pulley system 62. Said another way, once the transportable container 22 is initially formed with a few wraps of the stretch wrap 92 during initial simultaneous rotation of the upper and lower turntables 34, 50, the loading process of bulk goods into the transportable container 22 can maintain straightness and squareness during the entire fill cycle without the need to drive the upper turntable 34 with the upper pulley system 62. When a transportable base 98 is used, the upper turntable 34 is driven using only the overlapped layers of stretch wrap 92 extending between the transportable base 98 and the slip frame former 42

As best shown in FIG. 7, the plurality of pulley systems 62, 64, 66 also includes a variable pulley system 66 interconnected between the clutch 80 and the drive coupling 84 and disposed on the bottom support 48 for transferring the rotational force from the drive 60 to the coupling shaft 82 to drive 60 rotation of the upper pulley system 62 in the engaged position of the clutch 80. In the preferred embodiment, the variable pulley system 66 includes a variable pulley 100 and a variable belt 102 surrounding both of the variable pulley 100 and the drive coupling 84. The variable pulley system 66 also includes a jump shaft 104 extending between the variable pulley 100 and the clutch 80.

In a preferred embodiment, the slip frame former 42 may be altered to allow for the slip frame former 42 to be easily pulled away from the stretch wrap 92 as the level of the bulk goods in the transportable container 22 increases. For example, the at least one former wall 44 may be altered by a Teflon coating, a dimpled surface, or any other method known in the art for decreasing the amount of friction between the slip frame former 42 and the stretch wrap 92. Once the previously disposed portions of stretch wrap 92 are pulled away from the slip frame former 42, the roll of stretch wrap 92 of the stretch wrapping device 90 continues to overlap both the previously disposed portions of stretch wrap 92 and the slip frame former 42 during relative vertical movement of the bottom support 48 and the upper support 32 as well as continued simultaneous rotation of the upper and lower turntables 34, 50. This allows for the transportable container 22 to continue to form between the bottom support 48 on the transportable base 98 and the slip frame former 42. Said another way, as the level of bulk goods increases in the transportable container 22, at least one of the bottom support 48 and the upper support 32 are moved relative to one another to accommodate additional bulk goods and continue to form the transportable container 22 with the stretch wrap 92. During movement, the stretch wrap 92 is spirally wrapped at a predetermined level below the level of bulk goods to continue to overlap the stretch wrap 92 over both the previously disposed portions of stretch wrap 92 and the slip frame former 42.

The stretch wrapping device 90 can comprise a conventional stretch wrapping device 90 such as, for example, a Lantech Q series semi-automatic wrapper. Additionally, in the preferred embodiment, the stretch wrap 92 has a high cling factor and a width between 10 and 30 inches, but the stretch wrap 92 may be any of a variety of stretch wrap films known in the art. Other packaging materials such as netting, strapping, banding, or tape may be used as well. As best shown in FIG. 4, the stretch wrapping apparatus is also vertically moveable along a stretch wrapping guide 106 that runs parallel to the at least one support column 28. In the preferred embodiment, the stretch wrapping device 90, and thus the roll of stretch wrap 92, is guided along the stretch wrapping guide 106 by a motor (not expressly shown), but may be guided by any means known in the art.

The stretch wrap 92 generates hoop forces which apply a gentle squeeze to the bulk goods and thus help to stabilize the bulk goods disposed within the transportable container 22. The hoop forces stabilize the bulk goods by promoting controllable contact between the elements of the bulk goods being loaded into the transportable container 22, thereby promoting bridging between the components of the bulk goods. For example, when the bulk goods are a bulk cereal in puff or flake form, hoop forces promote bridging between cereal pieces, thereby reducing the relative motion between the pieces and immobilizing the cereal within the transportable container 22. Said another way, hoop forces allow for a very compact and rigid transportable container 22, which does not allow the bulk goods to shift or get crushed within the transportable container 22. In addition, the slip frame former 42 acts as a force control mechanism, i.e. the wrap is applied to the slip frame former 42 as opposed to being applied directly to the product. As such, the slip frame former 42 reduces product damage that could result from the direct application of the stretch wrap 92 to the bulk goods in the transportable container 22.

While the packaging system 20 could work with or without a bag 108, the preferred embodiment includes a scrunched bag system having an intermediate carrier 110 for holding a flexible bag 108 in an open and scrunched or bunched position. The bag 108 is preferably a gusseted bag 108 and can be formed from any suitable material for the bulk goods disposed in the bag 108 of the transportable container 22, such as for example, low density polyethylene, high density polyethylene, a food grade polymer, or nylon. The intermediate carrier 110 has a carrier base 112 and a plurality of carrier arms 114 extending from the carrier base 112 to an arm end 116. The carrier base 112 may be any shape known in the art, including but not limited to, round, square, rectangular, and U-shaped.

Each of the arm ends 116 may include a cap portion or may be rounded to assist with guiding the bag 108 onto and off the intermediate carrier 110. The arm ends 116 also maintain contact with the bag 108 to create an opening in the bag 108, and hold the bag 108 in its proper open position. The arm ends 116 push outwardly against an inside surface of the flexible bag 108 to create tension on the bag 108 and to secure the bag 108 onto the intermediate carrier 110.

In the exemplary embodiment, the intermediate carrier 110 is placed on a top hat portion 118 that extends from the upper turntable 34 of the upper support 32. The top hat portion 118 is secured to the upper turntable 34 such that when the upper turntable 34 rotates, the top hat portion 118 is rotatable therewith. The carrier arm 114 extends downwardly from the top hat portion 118 and through the feed opening 38 such that the bag 108 will be disposed and extend from the intermediate carrier 110 through the feed opening 38 of the upper support 32 and the frame opening 46 of the slip frame former 42 and to the transportable base 98 as bulk goods are fed from the feed source 24 into the bag 108.

Figure 5:
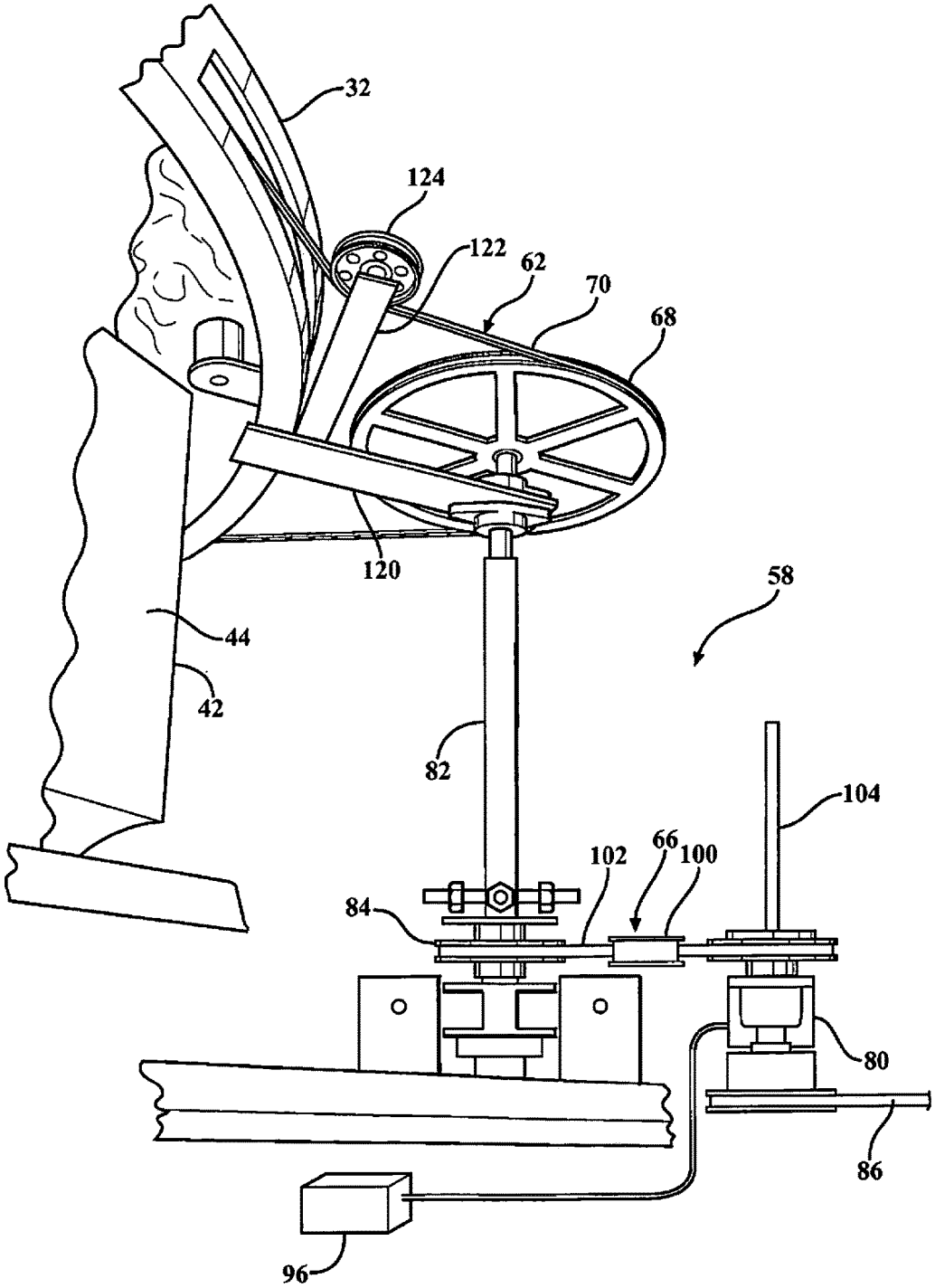
FIG. 5 is a magnified view of a portion of FIG. 4 illustrating the drive system including at least one pulley system.
Figure 6:
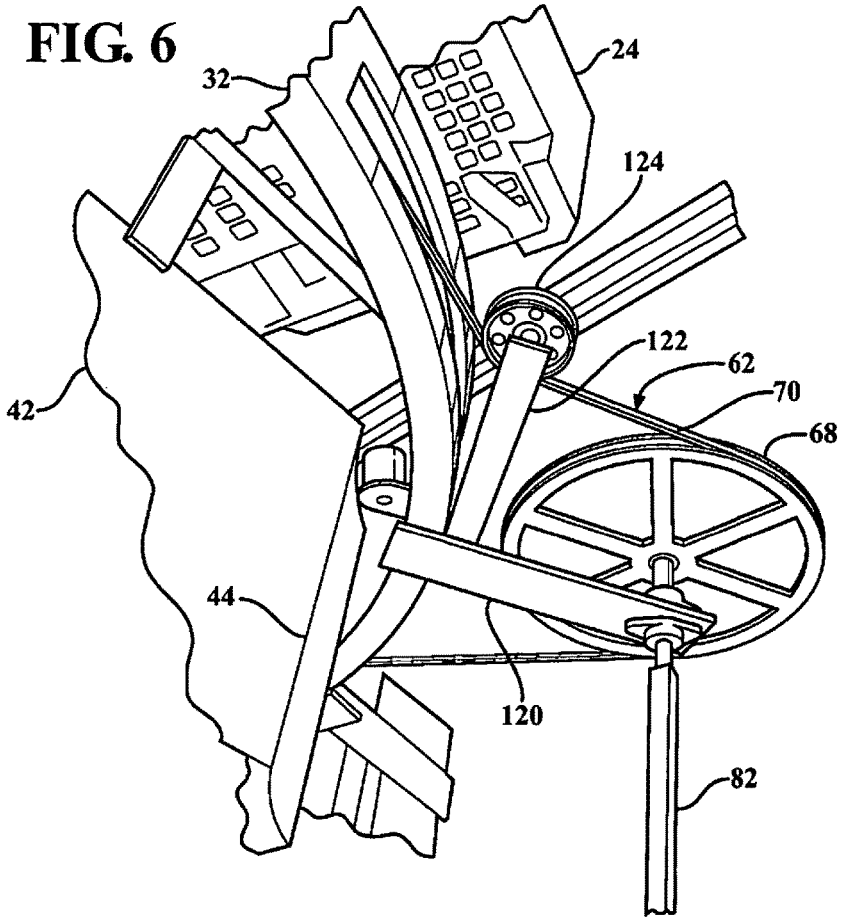
FIG. 6 is a magnified view of a portion of FIG. 6 illustrating the at least one pulley system including an upper pulley system interconnected to an upper turntable disposed within the upper support.

As best shown in FIGS. 4-6, the packaging system 20 also includes a support arm 120 extending outwardly from the upper support 32 to the coupling shaft 82 for rotatably supporting the second pulley and the coupling shaft 82. An upper tension arm 122 extends outwardly from the upper support 32 to an upper tension pulley 124 disposed in rotational engagement with the upper pulley 68. The upper tension pulley 124 is adjustable to alter a tension applied to the upper guide track 40 of the upper turntable 34 by the upper belt 70. The drive coupling 84 is slidably disposed about the coupling shaft 82 for sliding therealong during vertical movement of the bottom support 48.

As best shown in FIGS. 1-3, the upper turntable 34 includes at least one upper proximity flag 126 disposed adjacent the circumferential edge 36, and the upper support 32 correspondingly includes an upper proximity switch 128 disposed adjacent the circumferential edge 36 of the upper turntable 34. The upper proximity switch 128 monitors the upper proximity flag 126 during rotation of the upper turntable 34 to generate an upper proximity signal when the upper proximity flag 126 rotates past the upper proximity switch 128. As best shown in FIGS. 1 and 8, the lower turntable 50 also includes at least one lower proximity flag 130 and the bottom support 48 correspondingly includes a lower proximity switch 132 disposed adjacent the lower turntable 50. The lower proximity switch 132 monitors the lower proximity flag 130 during rotation of the lower turntable 50 to generate a lower proximity signal when the lower proximity flag 130 rotates past the lower proximity switch 132. For example, each of the proximity flags 126, 130 could be a metallic flag which is sensed by the proximity switches 128, 132 as the metallic flags 126, 130 rotate past the proximity switches 128, 132. In addition, although the Figures only illustrate a single proximity flag 128, 132 disposed on each of the upper and lower turntables 34, 50, it is also possible to add multiple proximity flags 126, 130 disposed in spaced relationship along each of the turntables 34, 50 to improve the accuracy of the monitoring of the turntables 34, 50 by the proximity switches 128, 132.

The controller 96 is disposed in communication with the upper and lower proximity switches 128, 132 for receiving the upper and lower proximity signals and associating a time stamp with each receipt of the proximity signals. Said another way, the controller 96 records a time of day when the upper and lower proximity flags 126, 130 pass by the proximity switches 128, 132. The controller 96 then proceeds to compare the respective time stamps of the upper and lower proximity signals to generate a timing difference between each respective time stamps of the upper and lower proximity signals. Said another way, the controller 96 determines how much time, for example number of seconds, that passes between each respective time stamp. In the preferred embodiment, when the upper and lower turntables 34, 50 are synchronized, the upper turntable 34 is set to run slightly ahead of the lower turntable 50. However, sometimes during rotation, the turntables 34, 50 can get out of sync and the upper turntable 34 can rotate too far ahead of the lower turntable 50. Accordingly, it is desirable in these situations to resynchronize the rotation of the upper and lower turntables 34, 50. Thus, the step of comparing the respective time stamps includes subtracting the respective time stamp of the lower proximity signal from the respective time stamp of the upper time stamp to calculate a timing difference between the respective time stamps. The controller 96 then proceeds to compare the respective timing differences to an upper predetermined timing threshold and a lower predetermined timing threshold. For example, each of the upper and lower predetermined timing thresholds could be values that are equal to a percentage of time that it takes the turntables 34, 50 to make an entire 360-degree rotation. Further, the upper predetermined timing threshold could be a value that equals 1-2% of the amount of time it takes the turntables 34, 50 to make an entire 360 degree rotation. The controller 96 then proceeds to generate a first alignment signal in response to the timing difference being less than lower predetermined threshold and a second alignment signal in response to the timing difference being greater than the upper predetermined timing threshold. The controller 96 proceeds to engage the clutch 80 in response to the second alignment signal to reapply the transfer of rotational force from the drive motor 76 to the upper pulley system 62 for accelerating the rotational speed of the upper turntable 34. The controller 96 also proceeds to cease transfer the rotational force from the drive motor 76 to the upper pulley system 62 in response to the second alignment signal to slow the rotational speed of the upper turntable 34 and allow realignment of the upper and lower turntables 34, 50. In addition, as previously mentioned, the disengagement of the clutch 80 allows the portions of stretch wrap 92 extending between the lower turntable 50 and the upper turntable 34 to manage the synchronization of the upper and lower turntables 34, 50. The control of the upper and lower turntables 34, 50 using the first and second alignment signals is advantageous because it allows for the tuning of the rotational speed of the upper turntable 34 simply by altering between use of the disengaged and engaged positions of the clutch 80, and thus helps in managing a packaging system 20 which drives 60 the upper turntable 34 with the stretch wrap 92.

Figure 10:
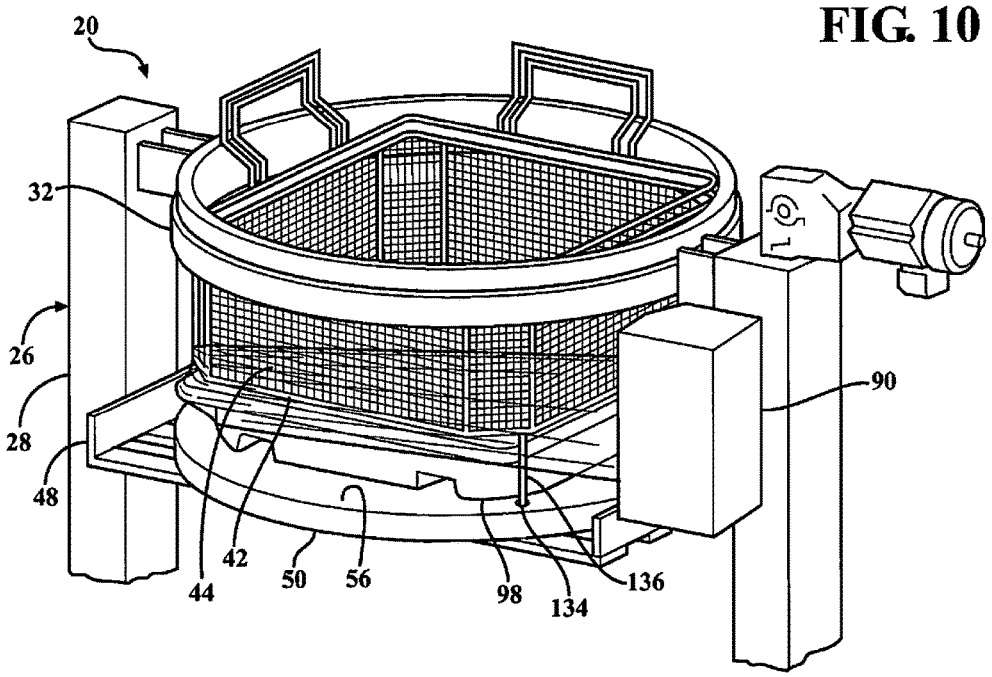
FIG. 10 is a perspective view of the packaging system illustrating a pin and a notch disposed in interlocking relationship in the first position of the upper and bottom supports.
Figure 11:
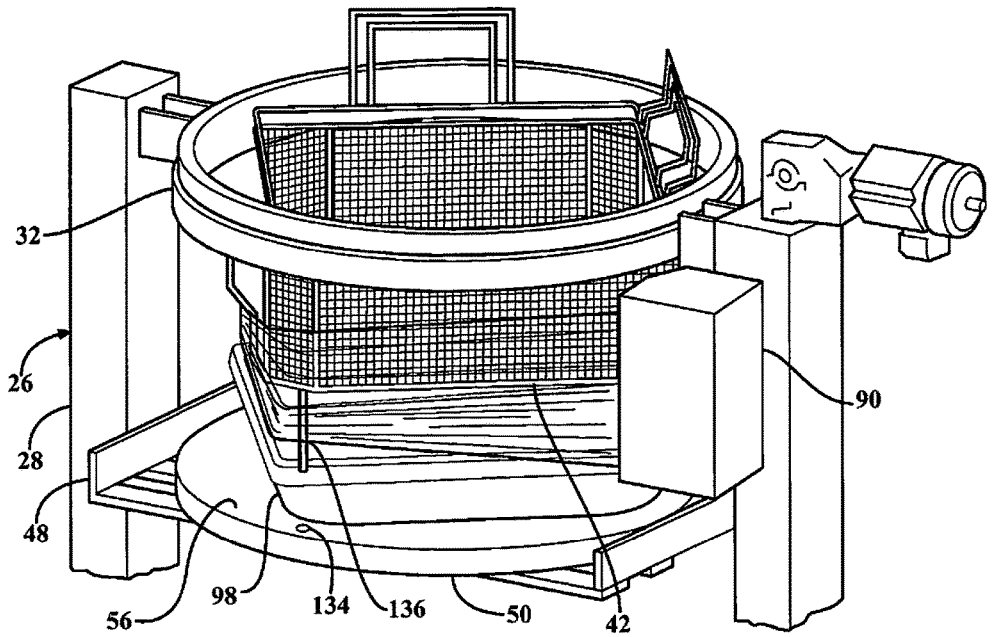
FIG. 11 is a perspective view of the packaging system illustrating relative vertical movement of one of the supports to raise the pin out of the notch to establish unlocked relationship of the upper and bottom supports.

In an alternative embodiment, the packaging system 20 only requires a single pulley system to simultaneously drive and synchronize a rotational speed of the upper and lower turntables 34, 50. In this alternative embodiment, the lower turntable 50 is disposed in interlocked relationship with the upper turntable 34 during the initial rotation of the upper and lower turntables 34, 50. As best shown in FIGS. 10-11, in the preferred embodiment of establishing the interlocked relationship, the lower turntable 50 defines a notch 134 and a pin 136 extends downwardly from the slip frame former 42. Accordingly, when the packaging system 20 is disposed in the first position as best shown in FIG. 10, the pin 136 is disposed within the notch 134 to establish interlocked relationship of the drive system 58. Similar to the other embodiment, the roll of stretch wrap 92 is disposed in overlapping relationship with at least a portion of the former wall 44 and the bottom support 48 to encircle the former wall 44 and the bottom support 48 during simultaneous and interlocked rotation of the upper and lower turntables 34, 50 to form the transportable container 22 extending therebetween. Also, at least one of the bottom support 48 and the upper support 32 are vertically movable relative to the other along the at least one support column 28 for disengaging previously disposed portions of the stretch wrap 92 from the slip frame former 42 and overlapping the previously disposed portions of stretch wrap 92 and the former wall 44 with the roll of stretch wrap during continued simultaneous rotation of the interlocked turntables 34, 50. As best shown in FIG. 11, when the bottom support 48 and the upper support 32 are vertically moved relative to the other along the at least one support column 28, the pin 136 is ultimately raised out of the notch 134 during the relative movement to disengage the interlocked relationship and establish an unlocked relationship of the upper and lower turntables 34, 50. Accordingly, in the unlocked relationship of the upper and lower turntables 34, 50 after the pin 136 is removed from the notch 134, the upper turntable 34 is driven using only the overlapped layers of stretch wrap 92 extending between the bottom support 48 and the upper turntable 34.

In the preferred embodiment, the single pulley system is a lower pulley system 64 in communication with the lower turntable 50. However, the packaging system 20 with only the lower pulley system 64 may not be robust enough to keep the upper turntable 34 and the lower turntable 50 in synchronized rotation depending on the type of bulk goods disposed within the transportable container 22. Accordingly, the packaging system 20 which includes the pin 136 and the notch 134 and the lower pulley system 64 could also be modified to include an upper pulley system 62 in communication with the upper turntable 34. In this arrangement, the drive 60 is disposed between and interconnected to both of the upper and lower pulley systems 62, 64, and a clutch 80 is disposed between the drive 60 and the upper pulley system 62. Similar to the earlier embodiments, the clutch 80 is adjustable from a disengaged position during the interlocked and simultaneous rotation of the turntables 34, 50 for ceasing transfer of the rotational force to the upper pulley system 62 to an engaged position during the unlocked rotation of the turntables 34, 50 for tuning synchronization of the rotational speeds of the turntables 34, 50 during the relative vertical movement. Said another way, the additional upper pulley system 62 could be added to adjust and tune the rotational speed of the upper turntable 34 when the pin 136 and the notch 134 are disposed in unlocked relationship. However, when this tuning feature is not required, the upper turntable 34 is only driven by the stretch wrap 92 extending between the bottom support 48 and the upper turntable 34.

A method of forming and filling a transportable container 22 includes simultaneously rotating an upper turntable 34 including a slip frame former 42 and a lower turntable 50 disposed on a bottom support 48 with a drive 60 to synchronize a rotational speed of the upper and lower turntables 34, 50. The method proceeds by applying stretch wrap 92 to at least a portion of the slip frame former 42 and the bottom support 48 during the simultaneous rotation of the upper and lower turntables 34, 50 to form a transportable container 22 extending therebetween, and then moving at least one of the upper turntable 34 and the bottom support 48 relative to one another to disengage previously disposed portions of stretch wrap 92 from the slip frame former 42 and overlap the previously disposed portions of stretch wrap 92 and the slip frame former 42 with the stretch wrap 92. Once the stretch wrap 92 is sufficiently disposed between the bottom support 48 and the slip frame former 42, the method proceeds by disengaging rotation of the upper turntable 34 with the drive 60 during the relative movement of the upper turntable 34 and the bottom support 48 to continue to drive rotation of the upper turntable 34 using only the overlapped layers of stretch wrap 92 extending between the bottom support 48 and the slip frame former 42. In the preferred embodiment, the simultaneous rotation of the upper and lower turntables 34, 50 is achieved with at least one pulley system 62, 64, 66 interconnected to the drive 60.

The method also provides for the tuning and re-synchronization of the rotational speeds of the upper and lower turntables 34, 50. In this embodiment, the method includes the steps of monitoring an upper proximity flag 126 disposed on the upper turntable 34 using an upper proximity switch 128 to generate an upper proximity signal when the upper proximity flag 126 rotates past the upper proximity switch 128, and monitoring a lower proximity flag 130 disposed on the lower turntable 50 using a lower proximity switch 132 to generate a lower proximity signal when the lower proximity flag 130 rotates past the lower proximity switch 132. Once the proximity signals are generated, the method proceeds by associating a time stamp with each receipt of the upper and lower proximity signals. In the preferred embodiment of the method, since the upper turntable 34 is set to run slightly faster than the lower turntable 50, the method includes subtracting the respective time stamp of the lower proximity signal from the respective time stamp of the upper time stamp to calculate a timing difference between the respective time stamps. Once the timing differences are calculated, the method proceeds by comparing each of the timing differences to a lower predetermined timing threshold to generate a first alignment signal in response to the timing difference being less than the lower predetermined timing threshold. As previously mentioned, the predetermined timing thresholds could be any desired values of time, such as number of seconds. If a first alignment signal is received, the method proceeds by re-engaging rotation of the upper turntable 34 with the drive 60 in response to the first alignment signal to re-synchronize the rotational speeds of the upper and lower turntables 34, 50. The method also includes the step of comparing of each of the timing differences to an upper predetermined timing threshold to generate a second alignment signal in response to the timing difference exceeding the upper predetermined timing threshold. If a second alignment signal is received, the method proceeds by disengaging rotation of the upper turntable 34 with the drive 60 in response to the second alignment signal to slow the rotational speed of the upper turntable 34.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A packaging system for forming and filling a transportable container with a plurality of bulk goods received from a feed source comprising:

a frame including a bottom support and an upper support and at least one support column extending therebetween;

an upper turntable rotatably supported within said upper support and defining a feed opening for receiving the bulk goods from the feed source;

a lower turntable rotatably supported on said bottom support;

a drive system including a drive interconnected to said upper and lower turntables for generating a rotational force to drive rotation of said upper and lower turntables; and said drive system including a plurality of pulley systems interconnected to said upper and lower turntables and said drive, said plurality of pulley systems configured to receive the rotational force from said drive and transmit the rotational force from said plurality of pulley systems to said upper and lower turntables to simultaneously drive and synchronize a rotational speed of said upper and lower turntables.

2. A packaging system as set forth in claim 1 further comprising:

said plurality of pulley systems including an upper pulley system in communication with said upper turntable for driving rotation of said upper turntable and a lower pulley system in communication with said lower turntable for driving rotation of said lower turntable.

3. A packaging system as set forth in claim 2 further comprising:

a slip frame former extending downwardly from said upper turntable and having at least one former wall to define a frame opening disposed in fluid communication with said feed opening;

at least one of said bottom support and said upper support being vertically movable relative to the other of said bottom support and said upper support along said at least one support column to define a first position wherein said bottom support is disposed adjacent said upper support and said slip frame former; and a stretch wrapping device including a roll of stretch wrap disposed in overlapping relationship with at least a portion of said former wall and said bottom support in said first position to encircle said former wall and said bottom support during an initial simultaneous rotation of said upper and lower turntables in said first position to form a transportable container extending therebetween for receiving the bulk goods from the feed source.

4. A packaging system as set forth in claim 3 further comprising:

at least one sensor extending downwardly from said upper support for sensing a fill level of the bulk goods within the transportable container in said first position;

said drive system including a controller in communication with said at least one sensor for receiving the fill level and comparing the fill level to a predetermined threshold to generate a fill signal when the fill level exceeds the predetermined threshold; and said controller in communication with at least one of said bottom support and said upper support to initiate vertical relative movement of said bottom support and said upper support in response to said fill signal for disengaging previously disposed portions of said stretch wrap from said slip frame former and overlapping the previously disposed portions of stretch wrap and said former wall with said roll of stretch wrap during continue simultaneous rotation of said turntables and vertical relative movement of said supports.

5. A packaging system as set forth in claim 4 further comprising:

said drive system including a clutch disposed between said drive and said upper pulley system being adjustable between an engaged position to allow transfer of the rotational force from said drive to said upper pulley system and a disengaged position to cease transfer of the rotational force from said drive to said upper pulley system; and said controller disposed in communication with said clutch of said drive system to disengage said clutch during said relative vertical movement of said supports and continue to drive rotation of said upper turntable using only said overlapped portions of stretch wrap extending between said bottom support and said slip frame former.

6. A packaging system as set forth in claim 5 further comprising:

said upper turntable including at least one upper proximity flag and said upper support including an upper proximity switch for monitoring said supper proximity flag during rotation of said upper turntable to generate an upper proximity signal when said upper proximity flag rotates past said upper proximity switch;

said lower turntable including at least one lower proximity flag and said bottom support including a lower proximity switch for monitoring said lower proximity flag during rotation of said lower turntable to generate a lower proximity signal when said lower proximity flag rotates past said lower proximity switch; and said controller in communication with said upper and lower proximity switches for receiving said upper and lower proximity signals and associating a time stamp with each receipt of said proximity signals and comparing respective time stamps of said upper and lower proximity signals to calculate a timing difference between respective time stamps and comparing each of said timing differences to a lower predetermined timing threshold to generate a first alignment signal in response to said timing difference being less than said lower predetermined timing threshold and engage said clutch in response to said first alignment signal to reapply the transfer of rotational force from said drive to said upper pulley system for resynchronizing the rotational speeds of said upper and lower turntables.

7. A packaging system as set forth in claim 6 wherein said controller is further configured to compare each of said timing differences to an upper predetermined timing threshold to generate a second alignment signal in response to said timing difference exceeding said upper predetermined timing threshold and disengage said clutch in response to said second alignment signal to cease transfer of the rotational force from said drive to said upper pulley system.

8. A packaging system as set forth in claim 5 further comprising:

said drive system including a coupling shaft extending downwardly from said upper pulley system to a drive coupling; and a variable pulley system interconnected between said clutch and said drive coupling for transferring the rotation force from said drive to said coupling shaft to drive rotation of said upper pulley system in said engaged position of said clutch.

9. A packaging system as set forth in claim 8 further comprising:

said variable pulley system including a variable pulley and a variable belt surrounding both of said variable pulley and said drive coupling; and a jump shaft extending between said variable pulley and said clutch.

10. A packaging system as set forth in claim 1 further comprising:

said upper turntable being circular and having a circumferential edge to define said feed opening and including an upper guide track extending downwardly from said circumferential edge;

said lower turntable including a turntable shaft rotatably connected to said bottom support and a lower guide track fixedly attached to said turntable shaft for rotation therewith and a lower turntable platform secured to said lower guide track for rotation with said turntable shaft and said lower guide track;

said upper pulley system including an upper pulley and an upper belt extending around both of said upper pulley and said upper guide track of said upper turntable; and said lower pulley system including a lower pulley and a lower belt extending around both of said lower pulley and said lower guide track of said lower turntable.

11. A packaging system for forming and filling a transportable container with a plurality of bulk goods received from a feed source comprising:

a frame including a bottom support and an upper support and at least one support column extending therebetween;

an upper turntable rotatably supported with said upper support and defining a feed opening for receiving the bulk goods from the feed source;

a lower turntable rotatably supported on said bottom support and disposed in interlocking relationship with said upper turntable;

a drive system including a drive interconnected to at least one of said upper and lower turntables for generating a rotational force to drive rotation of said upper and lower turntables; and said drive system including at least one pulley system interconnected with at least one of said upper and lower turntables and said drive, said at least one pulley system configured to receive the rotational force and transmit the rotational force to said interlocked upper and lower turntables to simultaneously drive and synchronize a rotational speed of said interlocked upper and lower turntables.

12. A packaging system as set forth in claim 11 further comprising:

a slip frame former extending downwardly from said upper turntable and having at least one former wall to define a frame opening disposed in fluid communication with said feed opening; and a stretch wrapping device including a roll of stretch wrap disposed in overlapping relationship with at least a portion of said former wall and said bottom support to encircle said former wall and said bottom support during simultaneous and interlocked rotation of said upper and lower turntables to form a transportable container extending therebetween for receiving the bulk goods from the feed source.

13. A packaging system as set forth in claim 12 further comprising:

at least one of said bottom support and said upper support being vertically movable relative to the other of said bottom support and said upper support along said at least one support column for disengaging previously disposed portions of said stretch wrap from said slip frame former and overlapping the previously disposed portions of stretch wrap and said former wall with said roll of stretch wrap during continued simultaneous and interlocked rotation of said upper and lower turntables.

14. A packaging system as set forth in claim 13 further comprising:

said drive system configured to disengage said interlocked relationship during relative vertical movement of said upper and lower supports and continue to drive rotation of said upper turntable using only said overlapped portions of stretch wrap extending between said bottom support and said upper turntable.

15. A packaging system as set forth in claim 14 further comprising:

said lower turntable defining a notch;

a pin extending downwardly from said slip frame former and disposed within said notch to establish said interlocked relationship of said turntables; and wherein said pin is raised out of said notch during said relative movement of said supports to disengage said interlocked relationship and establish an unlocked relationship of said upper and lower turntables.

16. A packaging system as set forth in claim 15 further comprising:

said at least one pulley system including a lower pulley system in communication with said lower turntable and an upper pulley system in communication with said upper turntable;

said drive disposed between and interconnected to both of said upper and lower pulley systems; and a clutch disposed between said drive and said upper pulley system and being adjustable between from a disengaged position during said simultaneous and interlocked rotation of said turntables for ceasing transfer of the rotational force to said upper pulley system to an engaged position during unlocked rotation of said turntables for tuning synchronization of the rotational speeds of said turntables during said relative vertical movement.

* * * * *